United States Patent [19]

Kato et al.

[11] 4,393,801

[45] Jul. 19, 1983

[54] SEWING MACHINE DUST COLLECTOR

[75] Inventors: Masahisa Kato; Syouji Kasugai; Osamu Gouda, all of Aichi, Japan

[73] Assignee: Mitsubishi Denki Kabushiki Kaisha, Tokyo, Japan

[21] Appl. No.: 349,109

[22] Filed: Feb. 16, 1982

[30] Foreign Application Priority Data

Feb. 19, 1981 [JP] Japan ..... 56-23276

[51] Int. Cl.[3] ..... D05B 71/00

[52] U.S. Cl. ..... 112/282; 112/DIG. 1; 15/339

[58] Field of Search ..... 112/282, DIG. 1, 280, 112/287; 15/347, 348, 352, 313, 339

[56] References Cited

U.S. PATENT DOCUMENTS

| | | | |
|---|---|---|---|
| 2,082,738 | 6/1937 | Vesconte | 112/282 X |
| 2,483,037 | 9/1949 | Christensen et al. | 112/282 X |
| 2,827,867 | 3/1958 | Happe | 112/282 X |
| 3,821,937 | 7/1974 | Sesselberg | 112/280 |

*Primary Examiner*—Werner H. Schroeder
*Assistant Examiner*—Andrew M. Falik
*Attorney, Agent, or Firm*—Sughrue, Mion, Zinn, Macpeak and Seas

[57] ABSTRACT

A dust collector for a sewing machine includes a dust collector box secured to a motor housing having a blower motor and a clutch motor disposed in axial alignment with each other. Suction hoses lead from the vicinity of the sewing machine to an inlet for the box and the outlet of the box is provided with a filter whereby a clean stream of air exiting from said box will pass over the motors to cool the same. The treadle operated control lever for the clutch for energizing the sewing machine is provided with a switch adapted to be closed upon engagement of the clutch and opened upon disengagement of the clutch. The switch is connected in series with a selective control switch for the blower motor whereby when the switch is in a first position the blower motor will be energized simultaneously with the engagement of the clutch and deenergized simultaneously with the disengagement of the clutch. When the switch is in a second or third position, the blower motor may be turned off or on independently of the clutch engagement.

5 Claims, 4 Drawing Figures

SEWING MACHINE DUST COLLECTOR

BACKGROUND OF THE INVENTION

The present invention is directed to a dust collector for a sewing machine and more particularly to a dust collector capable of automatically collecting waste cloth, waste threads, dust and other waste generated during a sewing operation, particularly a sewing operation utilizing an overseaming machine.

Conventional dust collector devices for sewing machines are generally comprised of a blower and a dust collecting box. One type of dust collector is provided with an additional motor-blower combination independent of the clutch motor adapted to drive the sewing machine. Generally, this type of dust collector is bulky and inconvenient to install relative to the conventional sewing machine drive. Another type of dust collector utilizes a blower which receives its power from the free end of the sewing machine clutch motor during normal rotation thereof. However, with this type of arrangement, the blower is usually provided with rotary blades which have a speed of rotation higher than that of the sewing machine clutch motor and which generally have an outer diameter larger than that of the clutch motor. In this type of arrangement, the clutch motor is primarily adapted to drive the sewing machine and when the blower is connected to the clutch motor it is necessary to provide a speed amplifier transmission arrangement between the free end of the clutch motor and the blower blades. Such an arrangement makes the overall structure very complicated while still producing an erratic output speed for the blower.

Furthermore, in both of the dust collecting arrangements discussed above, the blower is continuously operated regardless of the need for an actual dust collecting operation so that uncomfortably high noise levels are always generated by the blower while generally it is only necessary to carry out the dust collecting operation during only 20% to 30% of the actual sewing time.

Another type of dust collector for a sewing machine is disclosed in U.S. Patent application Ser. No. 313,141 filed on Oct. 20, 1981 U.S. Pat. No. 4,375,712 and assigned to the assignee of the present application. In that arrangement two collection boxes are utilized, one for thread scraps and the other for fabric scraps. Different diameter suction hoses are required for each box and the suction-blower motor is designed to operate only when the sewing machine is being operated and then continuously with the operation of the sewing machine.

SUMMARY OF THE INVENTION

The present invention provides a new and improved dust collector for a sewing machine which overcomes the aforementioned drawbacks of conventional dust collecting devices.

The present invention provides a new and improved dust collecting device for a sewing machine wherein a single dust collector is integrally associated with the sewing machine clutch motor thereby providing a compact, low cost structure exhibiting high performance, easy handling and low noise characteristics.

The present invention provides a new and improved dust collector for a sewing machine wherein the blower may be driven in cooperation with the clutch motor so as to synchronize the dust collecting operation with the actual sewing operation and if required, the blower may be operated independently of the sewing machine clutch motor so as to be selectively energized or deenergized in accordance with the specific sewing operation being carried out.

The present invention provides a new and improved dust collector for a sewing machine comprising a single dust collector box having air inlet means located relative to the sewing machine to facilitate the gathering of thread and fabric scraps, dust and the like and an air outlet having a suitable filter so as to retain the dust and scraps within said box, blower means having a longitudinal axis located adjacent said air outlet for drawing air through said inlet means, said box and said filter to provide a stream of air along said longitudinal axis and a sewing machine clutch motor having a longitudinal axis disposed in alignment with the longitudinal axis of said blower means whereby said stream of air passes through said clutch motor for cooling said clutch motor.

The present invention provides a new and improved dust collector for a sewing machine having a blower motor independent of the sewing machine clutch motor whereby the blower motor may be energized and deenergized either independently of the operation of the sewing machine or concurrently with the operation of the sewing machine.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
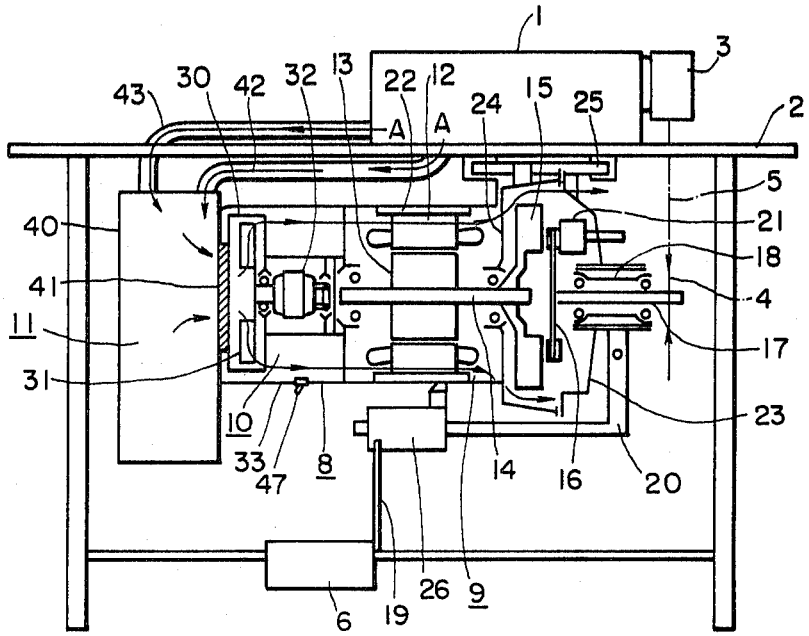
FIG. 1 is a schematic view showing the overall arrangement of a sewing table having an overseaming sewing machine, dust collector and clutch motor associated therewith in accordance with the present invention.
Figure 2:
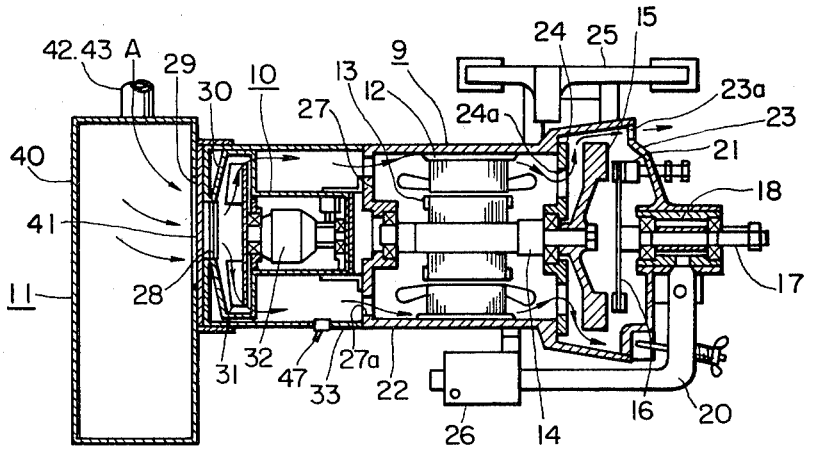
FIG. 2 is a sectional view showing the detailed structure of the clutch motor having a dust collector associated therewith.

Referring to the arrangement shown in FIGS. 1 and 2, a conventional overseaming type sewing machine 1 is mounted on a sewing machine table 2 and is driven by means of a power transmission belt 5 interconnecting the pulley 3 on the sewing machine with a pulley 4 which is operatively associated with the clutch motor 8. The clutch motor 8 includes a conventional clutch motor portion 9 for driving the sewing machine and a blower motor portion 10 associated with a dust collection box 11. The clutch motor portion 9 includes a stator 12, a rotor 13 and a motor shaft 14 secured to the rotor 13. A flywheel 15 is secured to the motor shaft 14 for rotation therewith and a clutch disc 16 is movable axially for selective engagement with the flywheel 15. The clutch disc 16 is secured to one end of a power transmission shaft 17 and the pulley 4 is secured to the opposite end thereof. A movable bearing 18 is provided for supporting the shaft 17 for movement along the axis thereof and a clutch lever 20 is operably connected to a foot pedal 6 through a connecting rod 19 for selectively moving the clutch disc 16 into and out of engagement with the flywheel 15. A brake shoe 21 is disposed adjacent the clutch disc 16 for frictional engagement therewith upon movement of the clutch disc 16 away from the flywheel 15 to stop the sewing machine. The clutch motor is provided with a housing 22 surrounding the motor, a first end wall 24 and an end housing 23 surrounding the clutch mechanism and providing support for the bearing 18 and shaft 17. The housing for the clutch motor is supported from the underside of the table by means of a mounting bracket 25. A motor control switch 26 is provided at one end of the clutch lever 20 which will close upon depression of the foot pedal 6 to engage the clutch to operate the sewing machine and which will open upon movement of the foot pedal to a raised position to provide disengagement of the clutch thereby terminating the sewing operation.

The blower motor portion 10 includes a blower motor 32, the axis of which is coaxially disposed in alignment with the shaft 14 of the clutch motor 9. The output shaft of the blower motor 32 has a plurality of rotary blades 31 connected thereto. The motor 32 and the blades 31 are enclosed within a casing 30 which is secured at one end thereof to the end wall 27 of the clutch motor 9. The entire blower-motor assembly is housed within a casing 33 which is coextensive with the housing 22 for the clutch motor. An aperture 28 is formed through the end walls of the casings 30 and 33 in alignment with an aperture 29 formed in the side of a dust collection box 40 which is secured to the end of the blower-motor assembly. A dust filter 41 is located between the apertures 28 and 29. A waste cloth collection hose 42 and a waste thread collection hose 43 are connected to the dust collection box 40. Thus, in operation when the blower motor 32 is in operation, the blades 31 will generate a stream of air through the tubes 42 and 43 which will draw all waste material, dust and the like into the dust collection box 40. The air stream will then pass through the filter 41 in the direction shown by the arrows in FIGS. 1 and 2 passing through the annular space defined between the casing 30 and 33, through the apertures 27*a* in the wall 27, past the clutch motor assembly, through the apertures 24*a* and 23*a* in the end wall 24 and end housing 23 respectively, to the exterior of the assembly.

Figure 3:
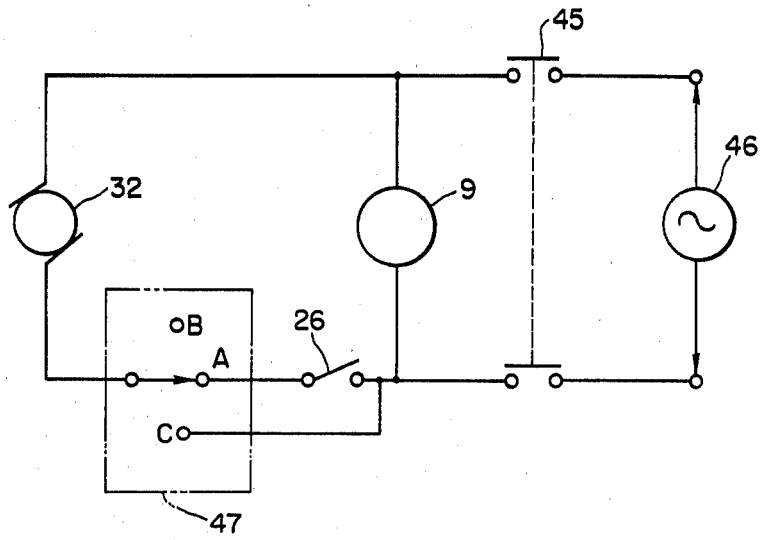
FIG. 3 is an electrical circuit diagram showing a first control circuit for the clutch motor and dust collector.

With respect to the electrical circuit as shown in FIG. 3, the clutch motor 9 which drives the sewing machine and the blower motor 32 which drives the blades 31 are connected in parallel to a power source 46 through a pushbutton switch 45. The blower motor 32 is connected to the power source through the switch 26 and a changeover switch 47 secured to the casing 33.

With this arrangement, when the changeover switch 47 is shifted to the contact position A and the power switch 45 is closed, only the clutch motor 9 will be energized to rotate the rotor 13 together with the flywheel 15. This is in the unloaded state so that the sewing machine 1 and the blower motor 32 are not operated. When the operator depresses the foot pedal 6 the clutch disc 16 will be coupled to the flywheel 15 to operate the sewing machine. Simultaneously, the switch 26 will be closed so that the blower motor 32 will be energized to rotate the rotary blades 31 at high speed. Because of the rotation of the blades 31, a high pressure air stream will be generated so that the air flow shown by the arrows A in FIG. 2 will draw all the waste cloth, waste threads, dust, etc. generated during the sewing operation into the collection box 40 through the hoses 42 and 43. The air stream is then filtered by means of the dust filter 41 and the filtered air stream then passes over the motor 9 as described above to cool the motor. Upon termination of the sewing operation, the operator restores the pedal 6 to its original position and the clutch disc 16 will be disengaged from the flywheel 15 to stop the sewing machine. Simultaneously, the switch 26 will be opened to deenergize the blower motor 32 and thus stop the blower. When the changeover switch 47 is shifted to the contact B, the blower motor 32 will be deenergized regardless of the foot pedal position so that the clutch motor can be operated in the usual manner without the operation of the dust collecting apparatus. When the changeover switch 47 is shifted to contact C, the blower motor is energized to provide an air stream regardless of the pedal position so that even after the completion of the sewing operation, cleanup can be achieved around the sewing machine 1 and the table 2 with the aid of the dust collecting hoses 42 or 43.

Figure 4:
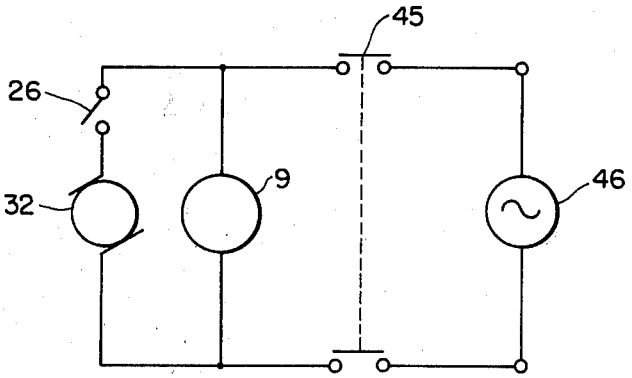
FIG. 4 is an electric circuit diagram of another embodiment of a control circuit for operating the clutch motor and dust collector.

A simplified motor control circuit is shown in FIG. 4 which is similar to the circuit shown in FIG. 3 but minus the changeover switch 47. Thus, whenever the switch 26 is closed upon depression of the foot pedal to operate the sewing machine, the blower motor 32 will be operated.

Thus, the present invention provides a new and improved compact arrangement wherein the blower motor portion 10 and the dust collecting box portion 11 are provided integrally with the clutch motor 9. With such an arrangement, the power transmission system of the blower motor portion 10 and the clutch motor portion 9 are independent with respect to each other so that it is not necessary to provide a mechanical power transmission coupling for operating the blower by utilizing the output of the clutch motor as is done in prior art devices. As a result, the overall structure is simplified. Since the blower motor portion is directly integral with the dust collection box portion, it is not necessary to provide an interconnecting hose or duct, thereby enabling a reduction in cost while enhancing the fluid stream efficiency. Moreover, according to the present invention, it is possible to energize or deenergize the blower as long as the main power switch 45 is closed regardless of whether or not the sewing machine is being operated. Therefore, the operation of the blower can be selectively made in accordance with the desired operating conditions to provide greater flexibility.

Finally, the arrangement according to the present invention utilizes the air stream generated for dust collection purposes as a cooling medium for the clutch motor so that a compact, efficient and economical design can be achieved. The air exhaust passages are directed away from the operator so as to prevent undesirable and uncomfortable drafts. By having a selective operation for the blower motor it is possible to reduce electrical power consumption and reduce unnecessary noise due to the operation of the blower motor. It is obvious that the selective switch can be further modified by the elimination of contacts B or C depending upon the specific needs of a customer.

While the invention has been particularly shown and described with reference to preferred embodiments thereof, it will be understood by those in the art that the foregoing and other changes in form and details may be made therein without departing from the spirit and scope of the invention.

What is claimed is:

1. A dust collector for use with a sewing machine comprising a clutch motor adapted to drive a sewing machine, suction means for collecting waste associated with the operation of said sewing machine including a blower motor, first control means for selectively energizing said blower motor in synchronization with the engagement of the clutch of said clutch motor and second control means adapted to selectively energize said blower motor independently of said first control means.

2. A dust collector as set forth in claim 1, wherein said suction means includes a dust collecting box having inlet means and outlet means and wherein said clutch motor and said blower motor each have a drive shaft, the axes of said drive shafts being aligned with each other and said outlet means whereby a stream of air from said outlet means passes axially over said blower motor and said clutch motor for cooling purposes.

3. A dust collector as set forth in claim 1, wherein said first control means is comprised of a treadle, lever means operatively connected to said clutch of said clutch motor and switch means having open and closed positions operatively associated with said lever means so as to be movable to the closed position upon engagement of said clutch and movable to the open position on disengagement of said clutch.

4. A dust collector as set forth in claim 3, further comprising circuit means connecting said clutch motor and said blower motor in parallel with a power source with said first and second control means connected in series between said clutch motor and said blower motor for selectively controlling the operation of said blower motor.

5. A dust collector as set forth in claim 4, wherein said second control means is comprised of a three position switch having a movable contact and three fixed spaced apart contacts, the first of said contacts being connected directly to said switch means of said first control means, said second contact being connected to a bypass circuit around said switch means of said first control means and said third contact being unconnected.

* * * * *